US012593934B2

(12) United States Patent
Homesombath et al.

(10) Patent No.: US 12,593,934 B2
(45) Date of Patent: Apr. 7, 2026

(54) CEILING GRID CLIP

(71) Applicant: InPro Corporation, Muskego, WI (US)

(72) Inventors: Joshua Homesombath, Racine, WI (US); David R. Gebhardt, Milwaukee, WI (US); Calvin T. Rupnow, Milwaukee, WI (US)

(73) Assignee: InPro Corporation, Muskego, WI (US)

( * ) Notice: Subject to any disclaimer, the term of this patent is extended or adjusted under 35 U.S.C. 154(b) by 110 days.

(21) Appl. No.: 18/527,003

(22) Filed: Dec. 1, 2023

(65) Prior Publication Data

US 2025/0176750 A1 Jun. 5, 2025

(51) Int. Cl.
*A47H 1/144* (2006.01)

(52) U.S. Cl.
CPC ..... *A47H 1/144* (2013.01)

(58) Field of Classification Search
CPC ..... A47H 1/144
USPC ..... 160/368.1
See application file for complete search history.

(56) References Cited

U.S. PATENT DOCUMENTS 1,884,414 A * 10/1932 Vroom ..... A47H 1/144 248/262
4,016,961 A * 4/1977 Howell, Jr. ..... B60M 1/34 191/22 DM
4,102,008 A 7/1978 Janson
4,306,332 A 12/1981 Simmons
D264,682 S 6/1982 Van Doren
4,336,757 A 6/1982 Toder
4,564,165 A * 1/1986 Grant ..... E04B 9/006 52/39
4,915,343 A * 4/1990 Terlecke ..... A47H 1/14 411/908
5,116,056 A 5/1992 Schmutte
D337,493 S 7/1993 King
D342,011 S 12/1993 Maguire
5,335,890 A 8/1994 Pryor et al.
(Continued)

FOREIGN PATENT DOCUMENTS

SE 85419 3/2024

OTHER PUBLICATIONS

Product Cut Sheet: I-Series Cubicle Curtain Track System. Product Sheet [online]. Mariak Contract [retrieved on Mar. 14, 2011]. Retrieved from the Internet: <URL: http://www.mariak.com/images/pdf/cubicle_curtain/CT%20Spec%20Cut%20Sheet%20I-Series.pdf>.

(Continued)

*Primary Examiner* — Kristina R Fulton
(74) *Attorney, Agent, or Firm* — Reinhart Boerner Van Deuren s.c.

(57) ABSTRACT

Embodiments of a ceiling grid clip assembly are provided. The ceiling grid clip assembly is configured to attach a rail, such as for hanging a curtain, to a ceiling, such as by the grid of a suspended ceiling. The ceiling grid clip assembly includes a rail receiving bracket and a ceiling grid lock having a plurality of engagement arms that form a receiving slot. The rail receiving bracket and the ceiling grid lock are configured to couple together without requiring additional components or fasteners. The ceiling grid lock is configured to couple to a portion of a ceiling grid by positioning the ceiling grid portion in a gap between the engagement arms and rotating the ceiling grid lock to position the ceiling grid portion in the receiving slot.

20 Claims, 7 Drawing Sheets

(56) References Cited

U.S. PATENT DOCUMENTS

| | | | | |
|---|---|---|---|---|
| 5,509,713 | A | 4/1996 | Hou | |
| D386,531 | S * | 11/1997 | Callas | D25/119 |
| D422,486 | S | 4/2000 | Wolfe | |
| 6,173,753 | B1 | 1/2001 | Laster-Bivens et al. | |
| 6,409,415 | B1 * | 6/2002 | Toder | E04B 9/006 52/39 |
| D513,171 | S | 12/2005 | Richardson | |
| 7,653,966 | B2 * | 2/2010 | Quinn | E05D 15/0647 16/93 R |
| D638,773 | S | 5/2011 | Laverack | |
| D661,533 | S | 6/2012 | Bennett et al. | |
| 8,327,591 | B2 * | 12/2012 | Wilkinson, Jr. | E04B 9/366 52/506.07 |
| 8,533,910 | B2 * | 9/2013 | Bennett | A47H 1/144 16/87.8 |
| D714,626 | S | 10/2014 | Trifari, Jr. | |
| D769,175 | S | 10/2016 | Aragon, Jr. | |
| D846,978 | S | 4/2019 | Dupont-Madinier | |
| 10,820,734 | B1 * | 11/2020 | Yu | A47H 1/142 |
| D938,815 | S | 12/2021 | Foral | |
| 11,213,157 | B1 * | 1/2022 | Liang | E06B 9/323 |
| D952,191 | S | 5/2022 | Muther | |
| D1,024,355 | S | 4/2024 | Lawson | |
| D1,029,297 | S | 5/2024 | Koval | |
| 12,042,076 | B1 * | 7/2024 | Yu | A47H 1/144 |
| 2002/0148938 | A1 * | 10/2002 | Kump | E04B 9/006 248/317 |
| 2004/0117945 | A1 * | 6/2004 | Huang | A47H 1/14 16/102 |
| 2007/0277944 | A1 | 12/2007 | Wu | |
| 2011/0061819 | A1 | 3/2011 | Elinson | |
| 2012/0246872 | A1 * | 10/2012 | Bennett | A47H 13/04 16/87.6 R |
| 2013/0167326 | A1 * | 7/2013 | Rowan | A47H 15/02 16/94 D |
| 2016/0374496 | A1 * | 12/2016 | Marcinik | A47H 15/02 160/331 |
| 2020/0102755 | A1 * | 4/2020 | Langtry | F16B 2/22 |
| 2021/0330112 | A1 * | 10/2021 | Hanley | E06B 9/323 |
| 2022/0202226 | A1 * | 6/2022 | Quatraro | A47H 1/04 |
| 2023/0055540 | A1 * | 2/2023 | Bailey | E04B 1/8404 |
| 2025/0102107 | A1 * | 3/2025 | Merrill, Jr. | F16M 13/02 |
| 2025/0176750 | A1 * | 6/2025 | Homesombath | A47H 1/144 |

OTHER PUBLICATIONS

Cubicle Curtain Tracks. Online Catalog [online]. Mariak Contract [retrieved on Mar. 14, 2011]. Retrieved from the Internet: <URL:http://www.mariak.com/index.php?option=com_content&view=article&id=53>.

Bendable Track. Online Catalog [online]. Konnect International [retrieved on Mar. 14, 2011]. Retrieved from the Internet: <URL: http ://www.konnectinternational.com/app/stx.products.asp?cid= 1 >.

T-Bar Application. Online Catalog [online]. Konnect International [retrieved on Mar. 14, 2011]. Retrieved from the Internet: <URL: http:// www.konnectinternational.com/app/stx.products.asp?cid= 16 >.

Roller. Online Catalog [online]. Konnect International [retrieved on Mar. 14, 2011]. Retrieved from the Internet: <URL:http://www.konnectinternational.com/app/stx.products.asp?cid=2 >.

Ceiling Mount Cartridge. Online Catalog [online]. Konnect International [retrieved on Mar. 14, 2011]. Retrieved from the Internet: <URL:http://www.konnectinternational.com/app/stx.products.asp?cid=4>.

Assembly Photo. Online Catalog [online]. Konnect International [retrieved on Mar. 14, 2011]. Retrieved from the Internet: <URL: http:// www.konnectinternational.com/app/stx.products.asp?cid= 19>.

Aluglide Bendable Track. Online Catalog [online]. Tracks & poles & things [retrieved on Mar. 14, 2011]. Retrieved from the Internet: <URL:http:/ /www.tracksandpoles.com/track set.shim I#>.

Nylon Wheel Carrier With Brass Ring. Online Catalog [online]. Sailbrite [retrieved on Mar. 14, 2011]. Retrieved from the Internet: <URL:http:// www.sailrite.com/RECMAR-4121-Nylon-Wheel-Carrier-With-Brass-Ring-Pk14>.

Nylon Block Carrier. Online Catalog [online]. Sailbrite [retrieved on Mar. 14, 2011]. Retrieved from the Internet: <URL:http://www.sailrite.com/RE CMAR-3312-Nylon-Block-Carrier>.

Bendable I Beam Curtain Track Aluminum 48" Long. Online Catalog [online]. Sailbrite [retrieved on Mar. 14, 2011]. Retrieved from the Internet: <URL:http://www.sailrite.com/RECMAR-4108-Bendable-I-Beam-Curtain-Track-Aluminum-48-Long>.

Office Action of May 13, 2008 in U.S. Appl. No. 11/442,973.

Inpro, Formatrac® Spring Clip with Grid Clip, [no date avail], searched Aug. 16, 2025, https://www.inprocorp.com/products/privacy-systems/cubicle-curtain-track-and-accessories/spring-clip-with-grid-clip (Year: 2025).

Inpro, Formatrac® Spring Clip, [no date avail], searched Jan. 7, 2026, https://www.inprocorp.com/products/privacy-systems/cubicle-curtain-track-and-accessories/formatrac-spring-clip/ (Year: 2025).

* cited by examiner

CEILING GRID CLIP

BACKGROUND OF THE INVENTION

The present invention relates generally to the field of ceiling curtain tracks. The present invention relates specifically to a clip assembly configured to connect a ceiling grid to a rail for hanging a curtain from a ceiling.

SUMMARY OF THE INVENTION

One embodiment of the invention relates to a ceiling grid clip assembly configured to attach a rail for hanging a curtain from a ceiling. The ceiling grid clip assembly includes a bracket integrally formed as a single continuous, contiguous component. The bracket includes a front side, a rear side, a top side, channel extending from the front side to the rear side and configured to receive the rail, and an opening located on the top side. The ceiling grid clip assembly also includes a grid lock integrally formed as a single continuous, contiguous component. The grid lock includes a top surface, a bottom surface, a first engagement arm located on a first side of the grid lock, a second engagement arm located on a second side of the grid lock, a receiving slot formed between the top surface and the first and second engagement arms, and a locking protrusion extending from the bottom surface. The locking protrusion of the grid lock interlocks with the bracket within the opening to couple the grid lock to the bracket. The grid lock is configured to couple to a ceiling grid by placing a portion of the ceiling grid in a gap between the first engagement arm and the second engagement arm and rotating the grid lock such that the portion of the grid lock is retained within the receiving slot.

Another embodiment of the invention relates to a ceiling grid clip assembly configured to attach a rail for hanging a curtain from a ceiling. The ceiling grid clip assembly includes a bracket integrally formed as a single continuous, contiguous component. The bracket includes a front side, a rear side, a top side, a channel extending from the front side to the rear side and being configured to receive the rail, and an opening located on the top side. The grid clip assembly also includes a grid lock integrally formed as a single continuous, contiguous component. The grid lock includes a top surface, a bottom surface, a first engagement arm located on a first side of the grid lock, a second engagement arm located on a second side of the grid lock, a receiving slot formed between the top surface and the first and second engagement arms and being configured to receive a portion of a ceiling grid, and a locking protrusion extending from the bottom surface. The locking protrusion of the grid lock passes through the opening of the bracket to couple the grid lock to the bracket. The locking protrusion is slidably adjustable between a locked position and an unlocked position within the opening of the bracket. The locking protrusion can be removed from the opening when in the unlocked position. The bracket prevents the locking protrusion from passing through the opening when in the locked position.

Another embodiment of the invention relates to a system for hanging a curtain from a ceiling. The system includes a bracket and a grid lock. The bracket includes a front side, a rear side, a top side, and a channel extending from the front side to the rear side and being configured to receive the rail. The grid lock includes a top surface, a bottom surface, a first engagement arm located on a first side of the grid lock, a second engagement arm located on a second side of the grid lock, and a receiving slot formed between the top surface and the first and second engagement arms. The system also includes a rail configured to attach to a curtain. The rail is coupled to the bracket within the channel. The grid lock is configured to couple to a ceiling grid by placing a portion of the ceiling grid in a gap between the first engagement arm and the second engagement arm and rotating the grid lock such that the portion of the grid lock is retained within the receiving slot.

Additional features and advantages will be set forth in the detailed description which follows, and, in part, will be readily apparent to those skilled in the art from the description or recognized by practicing the embodiments as described in the written description and claims thereof, as well as the appended drawings. It is to be understood that both the foregoing general description and the following detailed description are exemplary.

The accompanying drawings are included to provide further understanding and are incorporated in and constitute part of the specification. The drawings illustrate one or more embodiment, and together with the description serve to explain the principles and operation of various embodiments.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a ceiling grid clip assembly are shown. Embodiments of the ceiling grid clip assembly discussed herein include an innovative design to provide for a variety of desired characteristics, including secure attachment of a rail for hanging a curtain from a ceiling grid. Typically, traditional ceiling grid clips are assembled using multiple components to attach the clip to a ceiling grid and to a rail. In order to assemble the ceiling grid clip, users typically must use fasteners to secure the multiple components together.

Applicant has found it beneficial to provide a ceiling grid clip assembly that can be assembled and can couple a rail to a ceiling grid without the use of fasteners. This allows users to easily and quickly assemble and implement the ceiling grid clip, as well as reduce the number of components in the ceiling grid clip assembly. In some embodiments, the ceiling grid clip is integrally formed as a single continuous, contiguous component such that no assembly is required.

Figure 1B:
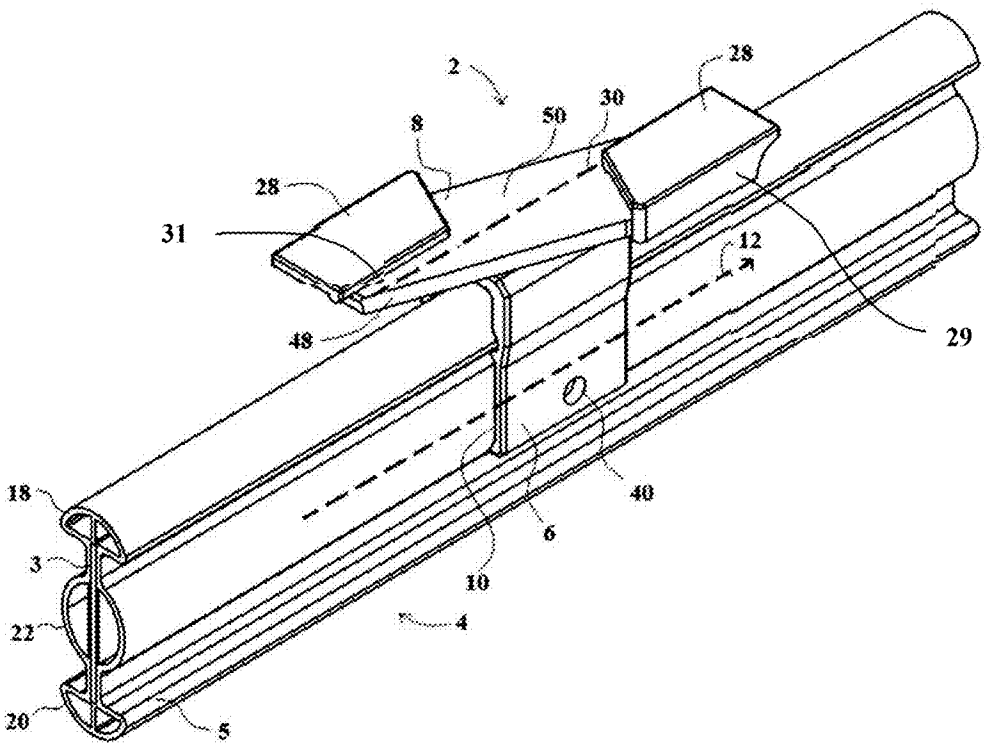
FIG. 1B is a top perspective view of a ceiling grid clip assembly coupled to a rail, according to an exemplary embodiment.
Figure 1A:
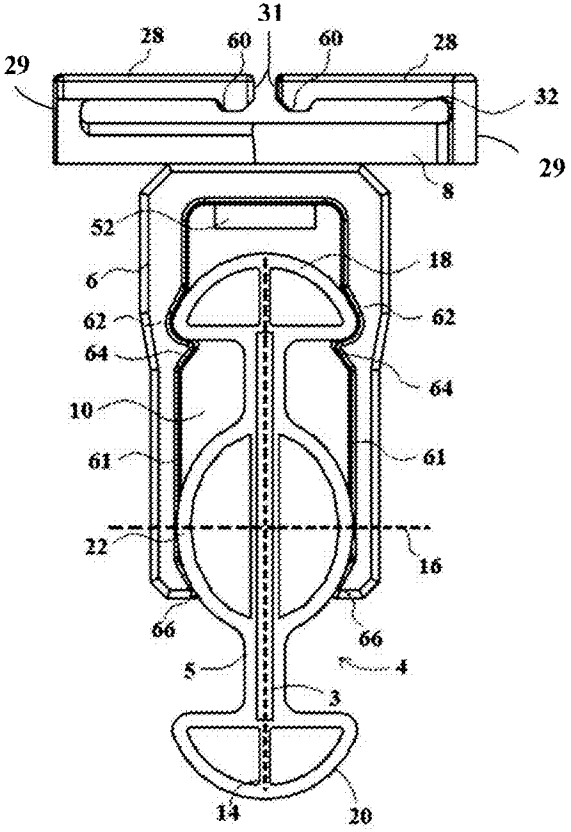
FIG. 1A is a side view of a ceiling grid clip assembly coupled to a rail, according to an exemplary embodiment.

Referring to FIG. 1A, a ceiling grid clip assembly 2 attached to a rail 4 is shown, according to an exemplary embodiment. Ceiling grid clip assembly 2 includes a rail receiving bracket 6 and a ceiling grid lock 8. Bracket 6 is coupled to ceiling grid lock 8 such that a top surface of bracket 6 is in direct contact with a bottom surface of ceiling grid lock 8. As shown in FIG. 1B, rail 4 extends through a channel 10 of bracket 6 along an entire length in a longitudinal direction 12 of bracket 6 such that rail 4 extends from a front surface of bracket 6 through a rear surface of bracket 6.

As shown in FIG. 1A, ceiling grid clip assembly 2 includes a central vertical axis 14 and a lateral axis 16. Rail 4 includes an upper retention lip 18, a lower retention lip 20, and a central protrusion 22. In a specific embodiment, each of upper retention lip 18, lower retention lip 20, and central protrusion 22 extend substantially away from vertical axis 14 in directions parallel to lateral axis 16. Upper retention lip 18 and central protrusion 22 are configured to engage with bracket 6 within channel 10 to couple rail 4 to bracket 6. Lower retention lip 20 is configured to attach rail attachments, such as carriers or hooks for hanging curtains, to ceiling grid clip assembly 2.

In a specific embodiment, rail 4 includes a core section 3 and an outer shell 5. Core section 3 is formed from an aluminum alloy, such as a 3105 aluminum with between a H22 and H24 temper. Outer shell 5 is formed from a thermoplastic, such as ABS or PVC. In some embodiments, bracket 6 and/or ceiling grid lock 8 are formed from injection molded thermoplastics, such as ABS or PVC. Alternatively, bracket 6 can be formed from a metal material, such as an aluminum alloy.

Figure 2B:
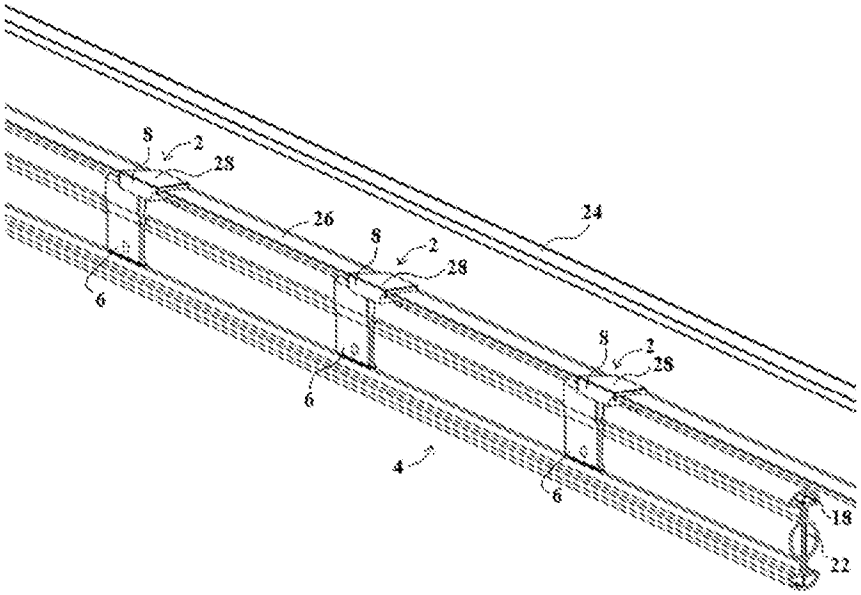
FIG. 2B is a top perspective view of a plurality of ceiling grid clip assemblies coupled to a rail and to a ceiling grid, according to an exemplary embodiment.
Figure 2A:
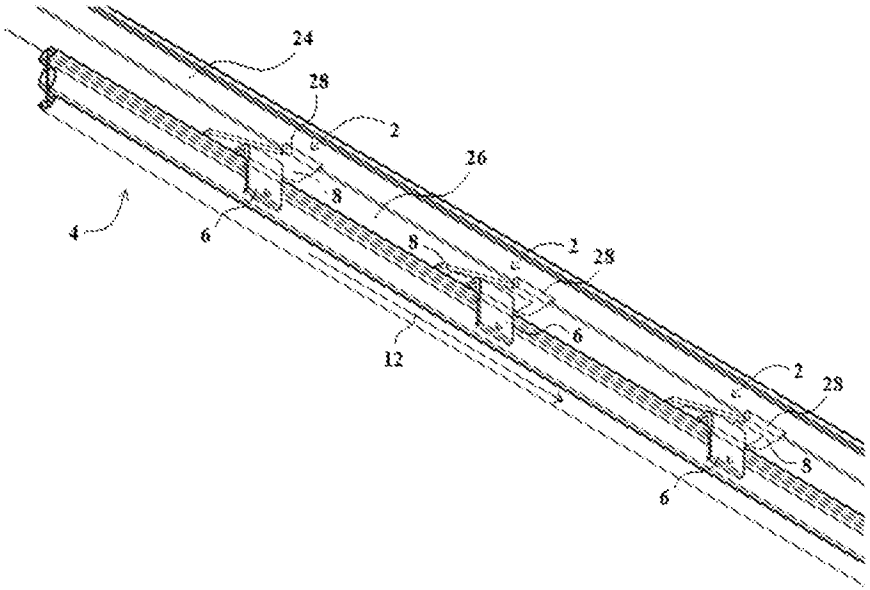
FIG. 2A is a bottom perspective view of a plurality of ceiling grid clip assemblies coupled to a rail and to a ceiling grid, according to an exemplary embodiment.

Referring to FIGS. 2A and 2B, ceiling grid clip assembly 2 attached to rail 4 and a ceiling grid portion 24 is shown, according to an exemplary embodiment. In some embodiments, rail 4 is coupled to ceiling grid portion 24 by a plurality of ceiling grid clip assemblies 2. As shown in FIG. 2B, ceiling grid clip assembly 2 couples to a laterally extending flat section 26 of ceiling grid portion 24 via an engagement arm 28 extending from ceiling grid lock 8. Referring back to FIGS. 1A and 1B, in some embodiments, ceiling grid lock 8 includes two engagements arms 28 located on opposing sides of ceiling grid lock 8 with respect to the lateral axis 16 and/or with respect to the longitudinal direction 12. Opposing engagement arms 28 extend from lateral edges of ceiling grid lock 8 toward a center line 30 of ceiling grid lock 8 that extends in the longitudinal direction 12 such that ceiling grid lock 8 forms a receiving slot 32 between engagement arms 28 and a top surface of ceiling grid lock 8. Ceiling grid lock 8 includes a gap 34 between opposing engagement arms 28 that extends at least partially in the longitudinal direction 12.

Figure 3D:
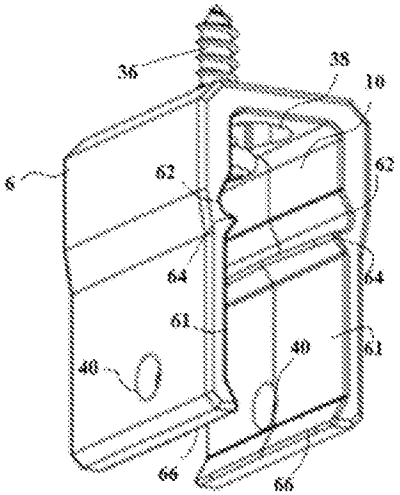
FIG. 3D is a bottom perspective view of the rail receiving bracket and fastener of FIG. 3C, according to an exemplary embodiment.
Figure 3E:
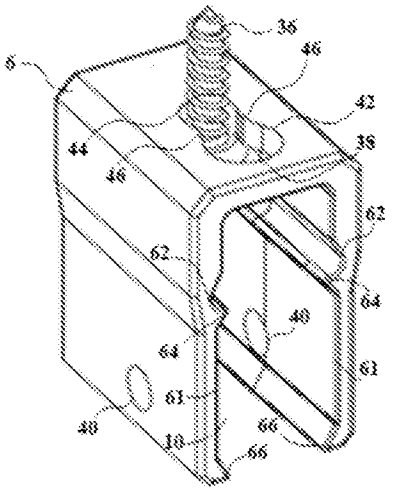
FIG. 3E is a top perspective view of the rail receiving bracket and fastener of FIG. 3C, according to an exemplary embodiment.
Figure 3C:
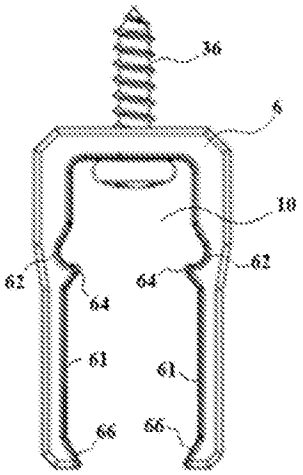
FIG. 3C is a side view of a rail receiving bracket and fastener, according to an exemplary embodiment.
Figure 3B:
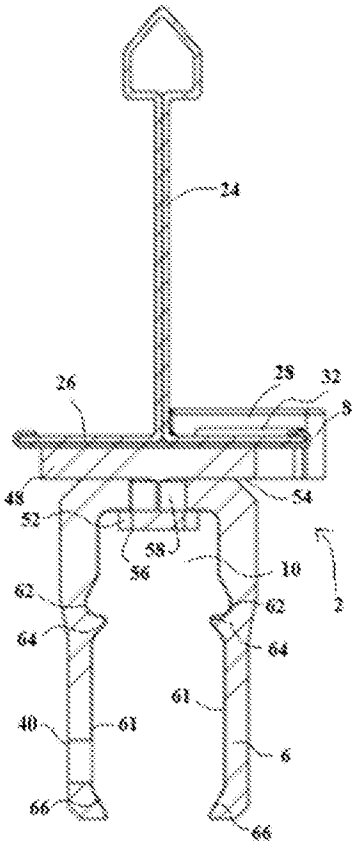
FIG. 3B is a side cross-sectional view of the ceiling grid clip assembly and rail of FIG. 3A, according to an exemplary embodiment.
Figure 3A:
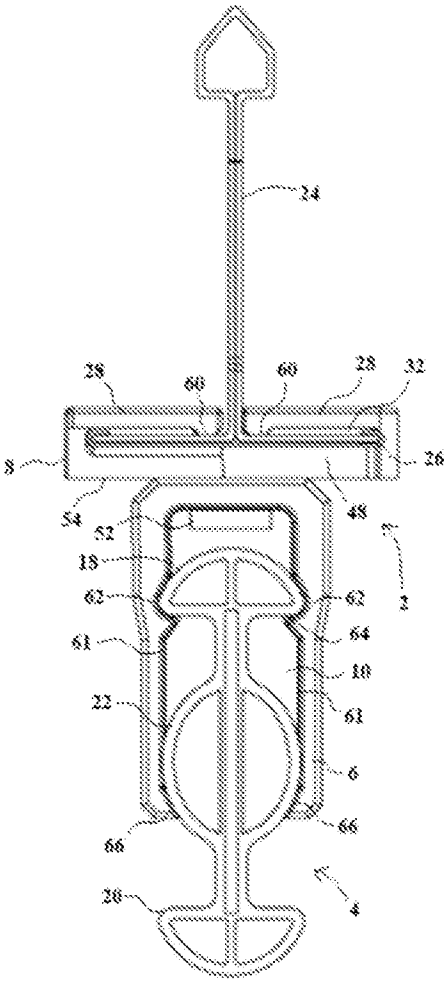
FIG. 3A is a side view of a ceiling grid clip assembly coupled to a rail and a ceiling grid portion, according to an exemplary embodiment.

Referring to FIGS. 3A and 3B, ceiling grid clip assembly 2 attached to ceiling grid portion 24 is shown, according to an exemplary embodiment. Ceiling grid lock 8 attaches to ceiling grid portion 24 by placing flat section 26 against a top surface of ceiling grid lock 8 in the gap 34 between engagement arms 28. Ceiling grid lock 8 is then rotated such that flat section 26 of ceiling grid portion 24 is retained within receiving slot 32. Applicant has found that attaching ceiling grid clip assembly 2 to ceiling grid portion 24 in the manner described above provides for a secure attachment that does not require fasteners, allows users to easily and quickly attach and detach ceiling grid clip assembly 2 to ceiling grid portion 24, and allows for the position of ceiling grid clip assembly 2 to be adjusted along ceiling grid portion 24 in the longitudinal direction 12.

In an alternative embodiment, bracket 6 is coupled to a ceiling or other surface without coupling bracket 6 to ceiling grid lock 8 and/or a ceiling grid portion 24. As shown in FIGS. 3C-3E, bracket 6 can include a fastener 36, such as a screw, nail, bolt, etc., that passes through an opening 38 on a top surface of bracket 6. Fastener 36 mounts bracket 6 to ceilings, including ceilings that are not suspended and/or include ceiling grids, such as finished drywall ceilings, by securing bracket 6 to an anchoring material in the ceiling, such as a joist, beam, drywall anchor, drywall, etc. Bracket 6 including fastener 36 allows users to mount rail 4 to a variety of ceiling configurations.

Figure 4B:
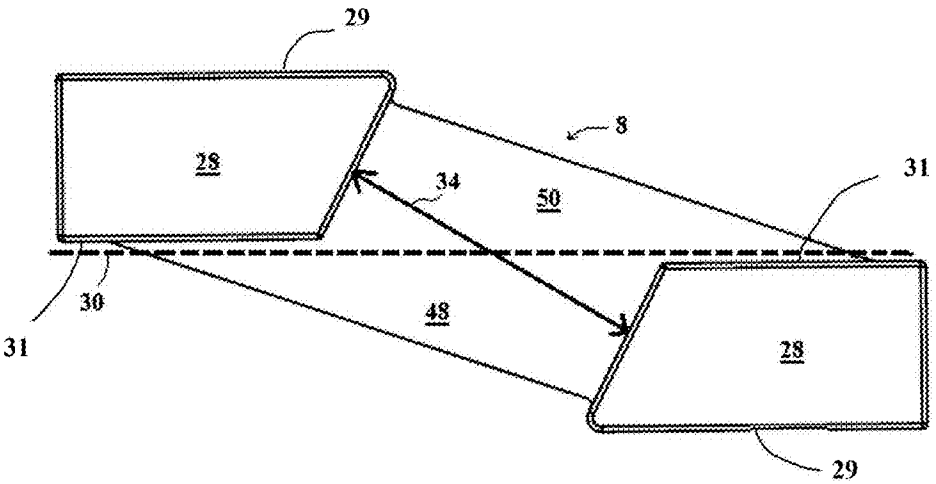
FIG. 4B is a top view of a ceiling grid lock, according to an exemplary embodiment.
Figure 4C:
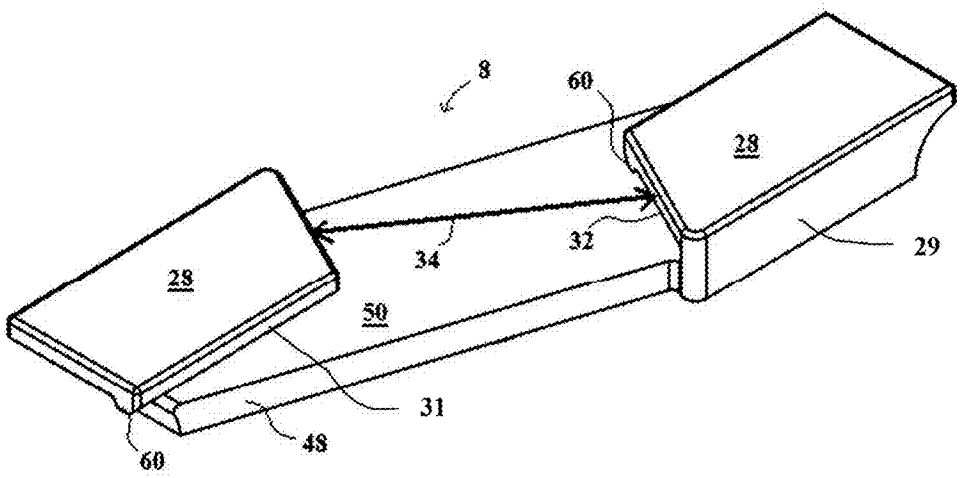
FIG. 4C is a top perspective view of a ceiling grid lock, according to an exemplary embodiment.
Figure 4A:
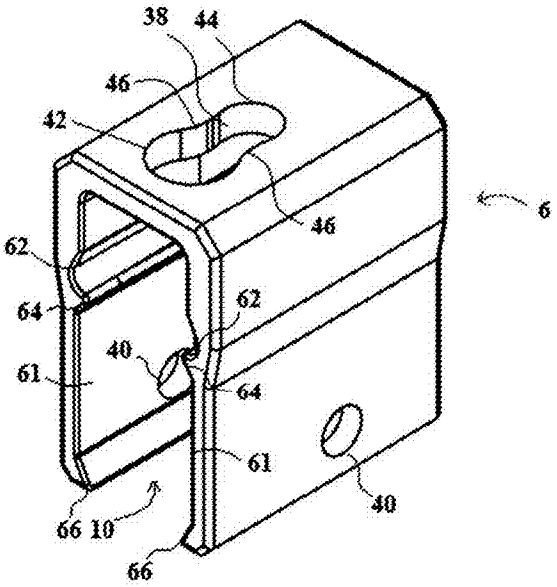
FIG. 4A is a top perspective view of a rail receiving bracket, according to an exemplary embodiment.

Referring to FIG. 4A, bracket 6 including opening 38 and coupling apertures 40 is shown according to an exemplary embodiment. A perimeter of opening 38 includes a first semi-circular edge 42, a second semi-circular edge 44, and concave arcuate edges 46. First semi-circular edge 42 is connected to second semi-circular edge 44 on each end by concave arcuate edges 46 to form an enclosed perimeter of opening 38. In a specific embodiment, the radius of first semi-circular edge 42 is greater than the radius of second semi-circular edge 44. Concave arcuate edges 46 are positioned such that a width of opening 38 in a lateral direction between concave arcuate edges 46 is smaller than twice the radius of first semi-circular edge 42 and smaller than twice the radius of second semi-circular edge 44.

Coupling apertures 40 are located on a left side and a right side of bracket 6, respectively. In a specific embodiment, coupling apertures 40 are configured to allow appropriate fasteners, such as screws, bolts, etc., to pass through bracket 6 from an outer surface into channel 10. Such fasteners can apply a clamping force to bracket 6 and rail 4 within channel 10 to secure and rigidly couple bracket 6 to rail 4, as well as bend the sides of bracket 6 toward rail 4 to increase contact area between bracket 6 and rail 4.

As shown in FIGS. 4B and 4C, ceiling grid lock 8 includes a bridge portion 48 extending under and between engagement arms 28 and having a top surface 50. Bridge portion 48 extends substantially in both the longitudinal direction 12 and laterally between engagement arms 28. Referring to FIGS. 1A and 4B, engagement arms 28 each extend from a base end 29 to a distal end 31 with the base end 29 and the distal end 31 terminating in substantially aligned orientations as viewed normal to the top surface 50 (e.g., shown in FIG. 4B), and engagement arms 28 are aligned and spaced apart from each other laterally such that there is a space between engagement arms 28 and such that engagement arms 28 do not overlap in a lateral direction. This space allows a vertically extending portion of ceiling grid portion 24 to pass between engagement arms 28 when ceiling grid clip assembly 2 is coupled to ceiling grid portion 24, as shown in FIG. 3A.

Figure 5B:
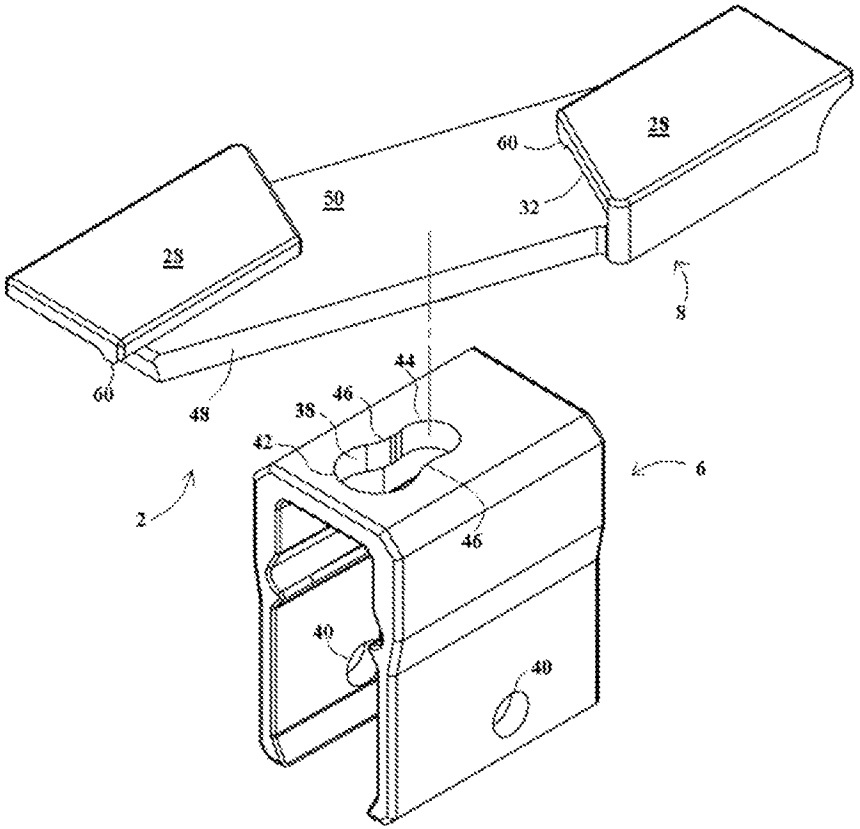
FIG. 5B is an exploded top perspective view of a ceiling grid clip assembly, according to an exemplary embodiment.
Figure 5A:
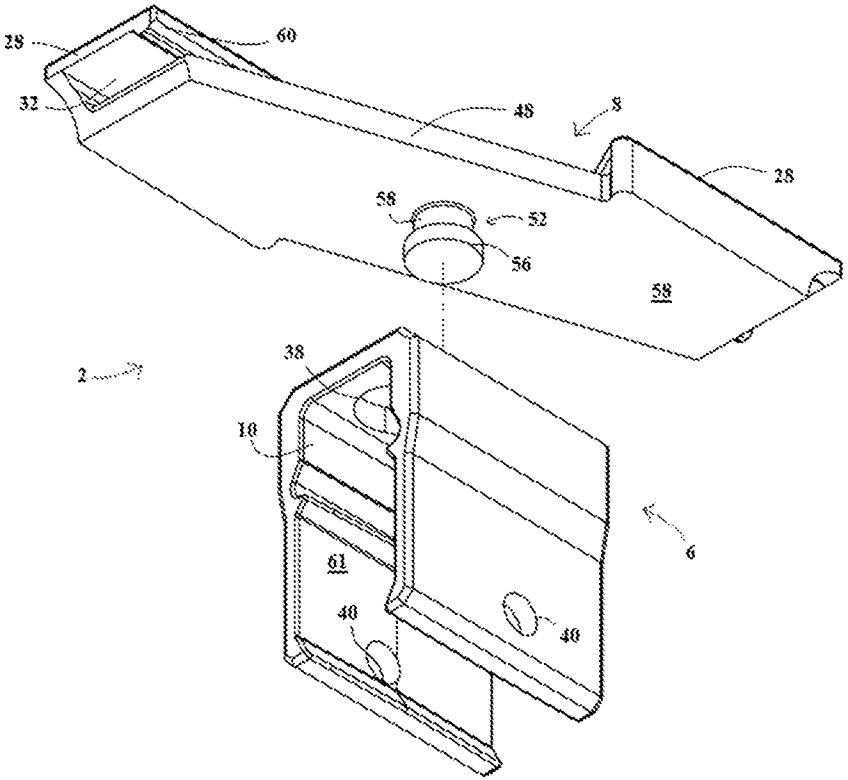
FIG. 5A is an exploded bottom perspective view of a ceiling grid clip assembly, according to an exemplary embodiment.

As shown in FIG. 5A, ceiling grid lock 8 includes a locking protrusion 52 extending from a bottom surface 54 of bridge portion 48. Locking protrusion 52 includes a lower lip 56 and a shaft 58. In a specific embodiment, lower lip 56 and/or shaft 58 are generally cylindrical. Lower lip 56 has a radius that is larger than the radius of shaft 58, larger than the radius of first semi-circular edge 42 of opening 38, and smaller than the radius of second semi-circular edge 44 of opening 38. Shaft 58 has a radius that is smaller than the radius of first semi-circular edge 42, smaller than the radius of second semi-circular edge 44, and larger than half of the narrowest width of opening 38 between concave arcuate edges 46.

Ceiling grid lock 8 is coupled to bracket 6 by first passing locking protrusion 52 through opening 38 and then sliding bracket 6 in the longitudinal direction 12 relative to ceiling grid lock 8 such that locking protrusion 52 is in contact with second semi-circular edge 44 of opening 38. The structure of locking protrusion 52 and opening 38 allows lower lip 56 to pass through opening 38 around first semi-circular edge 42 but does not allow lower lip 56 to pass through opening 38 around second semi-circular edge 44 due to the radial sizes of first semi-circular edge 42, second semi-circular edge 44, and lower lip 56. The radial sizes of shaft 58, first semi-circular edge 42, second semi-circular edge 44 are configured to allow shaft 58 to be retained within opening 38 at first semi-circular edge 42 and second semi-circular edge 44. The radial size of shaft 58 and the lateral width at the narrowest portion of opening 38 between concave arcuate edges 46 are configured such that when shaft 58 is moved between first semi-circular edge 42 and second semi-circular edge 44, bracket 6 flexes to expand the lateral width at the narrowest portion of opening 38 between concave arcuate edges 46 and/or locking protrusion 52 contracts to allow shaft 58 to pass between concave arcuate edges 46.

Applicant has found that the structure of locking protrusion 52 and opening 38 discussed above allows users to easily, quickly, and securely attach and detach bracket 6 to and from ceiling grid lock 8 without requiring additional components. As such, the structure of locking protrusion 52 and opening 38 provides a means for assembling ceiling grid clip assembly 2 without fasteners, thereby reducing the number of components in ceiling grid clip assembly 2 and reducing time and labor costs associated with assembling ceiling grid clip assembly 2. In an alternative embodiment, bracket 6 and ceiling grid lock 8 are integrally formed as a single contiguous, continuous component.

Figure 6F:
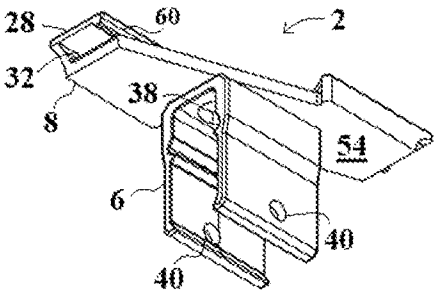
FIG. 6F is a bottom perspective view of a ceiling grid clip assembly, according to an exemplary embodiment.
Figure 6G:
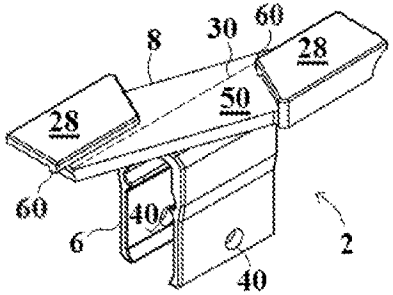
FIG. 6G is a top perspective view of a ceiling grid clip assembly, according to an exemplary embodiment.
Figure 6E:
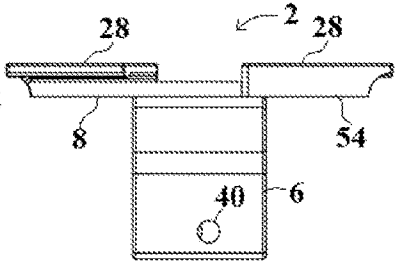
FIG. 6E is a right-side view of a ceiling grid clip assembly, according to an exemplary embodiment.
Figure 6B:
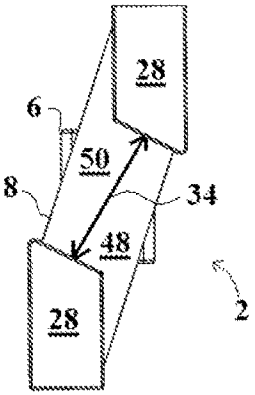
FIG. 6B is a top view of a ceiling grid clip assembly, according to an exemplary embodiment.
Figure 6C:
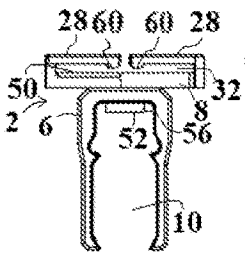
FIG. 6C is a front view of a ceiling grid clip assembly, according to an exemplary embodiment.
Figure 6D:
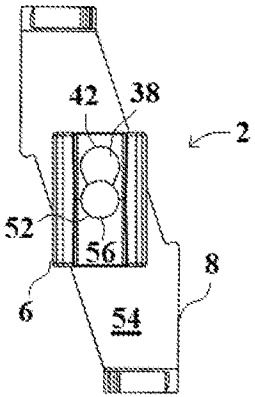
FIG. 6D is a bottom view of a ceiling grid clip assembly, according to an exemplary embodiment.
Figure 6A:
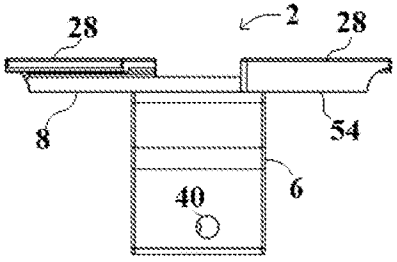
FIG. 6A is a left-side view of a ceiling grid clip assembly, according to an exemplary embodiment.

Referring to FIGS. 6A-6G, ceiling grid clip assembly 2 is shown in an assembled state, according to an exemplary embodiment. When ceiling grid clip assembly 2 is assembled, locking protrusion 52 is in a locked position within opening 38 such that locking protrusion 52 is retained in opening 38 at second semi-circular edge 44. As shown in FIG. 6C, lower lip 56 of locking protrusion 52 extends into channel 10 of bracket 6. Locking protrusion 52 is in an unlocked position within opening 38 when locking protrusion 52 is retained in opening 38 at first semi-circular edge 42 such that locking protrusion 52 can be removed from and pass through opening 38.

As shown in FIGS. 1A, 3A, and 6C, engagement arms 28 of ceiling grid lock 8 include retaining lips 60. Retaining lips 60 extend from ends of engagement arms 28 that are closest to centerline 30. Retaining lips 60 extends into receiving slot 32 and toward top surface 50 of bridge portion 48. Retaining lips 60 are configured to reduce the height of a portion of receiving slot 32 such that, when ceiling grid portion 24 is retained in receiving slot 32, retaining lips 60 contact and apply a normal force to ceiling grid portion 24. As such, frictional forces between retaining lips 60 and ceiling grid portion 24 prevent movement of ceiling grid clip assembly 2 relative to ceiling grid portion 24 until sufficient force is applied.

Referring to FIGS. 7A-7E, bracket 6 is shown according to an exemplary embodiment. Channel 10 of bracket 6 is located between opposing walls 61. Walls 61 include recesses 62, upper retaining edges 64, and lower retaining edges 66. Recesses 62 have concave arcuate shapes that result in a greater distance between opposing walls 61 than elsewhere along opposing walls 61. Referring back to FIG. 1A, recesses 62 are configured to provide sufficient space to allow upper retention lip 18 of rail 4 to pass through channel 10. Upper retaining edges 64 extend inward from walls 61 and are located beneath recesses 62 to support a lower surface of upper retention lip 18 of rail 4, when rail 4 is retained within channel 10. Lower retaining edges 66 extend inward from walls 61 at a bottom end of walls 61. Lower retaining edges 66 are configured to support a lower surface of central protrusion 22 of rail 4.

Figure 7E:
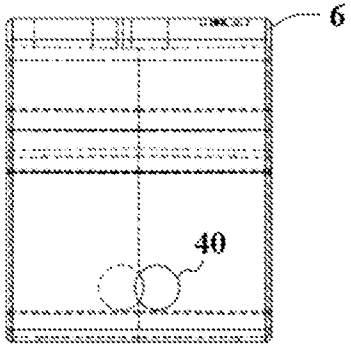
FIG. 7E is a right view of a rail receiving bracket, according to an exemplary embodiment.
Figure 7B:
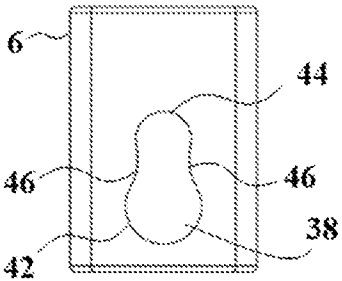
FIG. 7B is a top view of a rail receiving bracket, according to an exemplary embodiment.
Figure 7C:
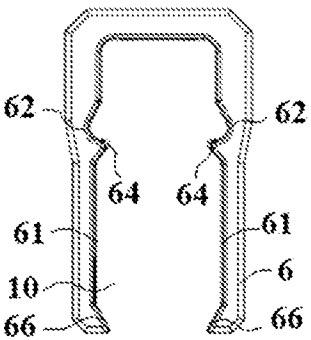
FIG. 7C is a front view of a rail receiving bracket, according to an exemplary embodiment.
Figure 7D:
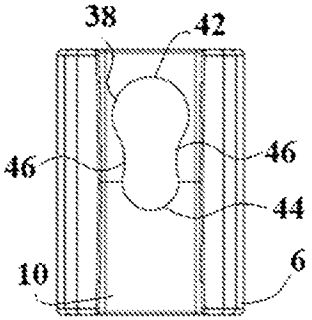
FIG. 7D is a bottom view of a rail receiving bracket, according to an exemplary embodiment.
Figure 7A:
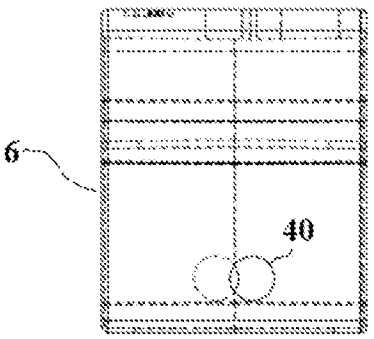
FIG. 7A is a left-side view of a rail receiving bracket, according to an exemplary embodiment.

As shown in FIGS. 7A and 7E, in a specific embodiment, coupling apertures 40 are offset with respect to each other in the longitudinal direction 12 such that one of coupling apertures 40 is closer to a front side of bracket 6 than the other coupling aperture 40.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. As used herein, the article "a" is intended to include one or more component or element and is not intended to be construed as meaning only one.

What is claimed is:

1. A ceiling grid clip assembly configured to attach a rail for hanging a curtain from a ceiling, the ceiling grid clip assembly comprising:

a bracket integrally formed as a single continuous, contiguous component, the bracket including:

a front side;

a rear side;

a top side;

a channel extending from the front side to the rear side, the channel being configured to receive the rail; and an opening located on the top side; a grid lock integrally formed as a single continuous, contiguous component and defining a longitudinal center line, the grid lock including:

a bridge portion having a top surface and a bottom surface extending in a longitudinal direction between a first end and a second end of the bridge portion; a first engagement arm located on a first side of the grid lock and extending from a first base end toward the longitudinal center line to a first distal end and extending beyond the first end of the bridge portion; and a grid lock integrally formed as a single continuous, contiguous component and defining a longitudinal center line, the grid lock including:

a top surface;

a bottom surface;

a first engagement arm located on a first side of the grid lock and extending from a first base end toward the longitudinal center line to a first distal end;

a second engagement arm located on a second side of the grid lock and extending from a second base end toward the longitudinal center line to a second distal end;

a receiving slot formed between the top surface and the first and second engagement arms; and a locking protrusion extending from the bottom surface;

wherein the locking protrusion of the grid lock interlocks with the bracket within the opening to couple the grid lock to the bracket;

wherein the grid lock is configured to couple to a ceiling grid by placing a portion of the ceiling grid in a gap between the first engagement arm and the second engagement arm and rotating the grid lock such that the portion of the ceiling grid is retained within the receiving slot; and wherein the first base end and the first distal end terminate in substantially aligned orientations as viewed normal to the top surface.

2. The ceiling grid clip assembly of claim 1, wherein a perimeter of the opening of the bracket comprises a first semi-circular edge having a first radius and a second semi-circular edge having a second radius;

wherein the first radius is greater than the second radius.

3. The ceiling grid clip assembly of claim 2, the locking protrusion of the grid lock comprising a shaft having a third radius and a lower lip portion having a fourth radius;

wherein the fourth radius is less than the first radius and greater than the second radius; and wherein the third radius is less than the first radius and less than the second radius.

4. The ceiling grid clip assembly of claim 3, the perimeter of the opening of the bracket further comprising a first concave arcuate edge between the first semi-circular edge and the second semi-circular edge and a second concave arcuate edge between the first semi-circular edge and the second semi-circular edge opposite the first concave arcuate edge;

wherein a width of the opening between the first concave arcuate edge and the second concave arcuate edge is less than twice the third radius.

5. The ceiling grid clip assembly of claim 4, wherein the bracket comprises a material selected from the group consisting of thermoplastic and aluminum.

6. The ceiling grid clip assembly of claim 4, the bracket further comprising opposing side walls that define the channel, the side walls including a recess that increases a width of the channel and an upper retaining edge that extends into the channel;

wherein the recess and the upper retaining edge are configured to engage an upper portion of the rail.

7. The ceiling grid clip assembly of claim 6, the side walls of the bracket further comprising a lower retaining edge configured to engage a lower portion of the rail.

8. The ceiling grid clip assembly of claim 1, wherein the second engagement arm further extending beyond the second end of the bridge portion.

9. The ceiling grid clip assembly of claim 1, wherein the first side and the second side of the grid lock are located on opposing sides of the grid lock with respect to a center line that extends across the grid lock in a same direction as the channel when the grid lock is coupled to the bracket.

10. The ceiling grid clip assembly of claim 1, wherein the grid lock is detached from the bracket; and wherein a screw configured to couple the bracket directly to a ceiling is coupled to the bracket within the opening.

11. A ceiling grid clip assembly configured to attach a rail for hanging a curtain from a ceiling, the ceiling grid clip assembly comprising:

a bracket integrally formed as a single continuous, contiguous component, the bracket including:

a front side;

a rear side;

a top side;

a channel extending from the front side to the rear side, the channel being configured to receive the rail; and an opening located on the top side;

a grid lock integrally formed as a single continuous, contiguous component and defining a longitudinal direction, the grid lock including:

a bridge portion having a top surface and a bottom surface extending in the longitudinal direction between a first end and a second end of the bridge portion;

a first engagement arm located on a first side of the grid lock and extending in the longitudinal direction from a first inner end to a first outer end that extends beyond the first end of the bridge portion;

a second engagement arm located on a second side of the grid lock and extending in the longitudinal direction from a second inner end to a second outer end;

a receiving slot formed between the top surface and the first and second engagement arms, the receiving slot being configured to receive a portion of a ceiling grid; and a locking protrusion extending from the bottom surface;

wherein the locking protrusion of the grid lock passes through the opening of the bracket to couple the grid lock to the bracket;

wherein the locking protrusion is slidably adjustable between a locked position and an unlocked position within the opening of the bracket;

wherein the locking protrusion can be removed from the opening when in the unlocked position; and wherein the bracket prevents the locking protrusion from passing through the opening when in the locked position.

12. The ceiling grid clip assembly of claim 11, wherein the grid lock is configured to couple to a ceiling grid by placing a portion of the ceiling grid in a gap between the first engagement arm and the second engagement arm and rotating the grid lock such that the portion of the ceiling grid is retained within the receiving slot.

13. The ceiling grid clip assembly of claim 12, wherein a perimeter of the opening of the bracket comprises a first semi-circular edge having a first radius and a second semi-circular edge having a second radius;

wherein the first radius is greater than the second radius.

14. The ceiling grid clip assembly of claim 13, the locking protrusion of the grid lock comprising a shaft having a third radius and a lower lip portion having a fourth radius;

wherein the fourth radius is less than the first radius and greater than the second radius; and wherein the third radius is less than the first radius and less than the second radius.

15. The ceiling grid clip assembly of claim 14, wherein the locking protrusion is in the unlocked position when the shaft is in contact with the first semi-circular edge, and the locking protrusion is in the locked position when the shaft is in contact with the second semi-circular edge.

16. The ceiling grid clip assembly of claim 14, the perimeter of the opening of the bracket further comprising a first concave arcuate edge between the first semi-circular edge and the second semi-circular edge and a second concave arcuate edge between the first semi-circular edge and the second semi-circular edge opposite the first concave arcuate edge;

wherein a width of the opening between the first concave arcuate edge and the second concave arcuate edge is less than twice the third radius.

17. The ceiling grid clip assembly of claim 11, wherein the grid lock is detached from the bracket; and wherein a screw configured to couple the bracket directly to a ceiling is coupled to the bracket within the opening.

18. A system for hanging a curtain from a ceiling, the system comprising:

a bracket including:

a front side;

a rear side;

a top side;

a channel extending from the front side to the rear side, the channel being configured to receive a rail; a grid lock including:

a bridge portion having a top surface and a bottom surface extending in a longitudinal direction between a first end and a second end of the bridge portion;

a first engagement arm located on a first side of the grid lock extending toward a longitudinal center line of the grid lock and having a first distal end extending beyond the first end of the bridge portion, the first distal end defining a first retaining lip extending toward the top surface a grid lock including:

a top surface;

a bottom surface;

a first engagement arm located on a first side of the grid lock and having a first distal end defining a first retaining lip extending toward the top surface;

a second engagement arm located on a second side of the grid lock and having a second distal end defining a second retaining lip extending toward the top surface;

a receiving slot formed between the top surface and the first and second engagement arms; and a rail configured to attach to a curtain, the rail being coupled to the bracket within the channel; and wherein the first retaining lip and the second retaining lip reduce a height of a portion of the receiving slot; and wherein the grid lock is configured to couple to a ceiling grid by placing a portion of the ceiling grid in a gap between the first engagement arm and the second engagement arm and rotating the grid lock such that the portion of the ceiling grid is retained within the receiving slot.

19. The system of claim 18, the bracket further comprising opposing side walls that define the channel, the side walls including a recess that increases a width of the channel, an upper retaining edge that extends into the channel, and a lower retaining edge that extends into the channel;

wherein the recess and the upper retaining edge are configured to engage an upper portion of the rail; and wherein the lower retaining edge is configured to engage a lower portion of the rail.

20. The system of claim 18, wherein the bracket and the grid lock are integrally formed together as a single continuous, contiguous component.

* * * * *